US006688549B1

(12) United States Patent
Shen

(10) Patent No.: US 6,688,549 B1
(45) Date of Patent: Feb. 10, 2004

(54) ADHESIVE TAPE REEL LOADING STRUCTURE

(76) Inventor: Dick Shen, No. 41-6, Ta-Hu, Ta-Kang Tsun, Kuei-Shan Hsiang, Tao-Yuan Hsien (TW)

( * ) Notice: Subject to any disclaimer, the term of this patent is extended or adjusted under 35 U.S.C. 154(b) by 0 days.

(21) Appl. No.: 10/101,371

(22) Filed: Mar. 20, 2002

(51) Int. Cl.[7] ..... B65H 75/24; B65H 16/04
(52) U.S. Cl. ..... 242/588; 242/597.6
(58) Field of Search ..... 242/588, 588.6, 242/597.2, 597.6, 598.2, 598.3, 598.4, 599, 129.6; 225/47, 66, 77

(56) References Cited

U.S. PATENT DOCUMENTS 2,694,533 A * 11/1954 Zucker ..... 242/588.6
2,759,545 A * 8/1956 Rizza ..... 225/34
2,929,907 A * 3/1960 Collins ..... 242/598.6
3,403,869 A * 10/1968 Marchisen et al. ..... 242/597.8
4,059,210 A * 11/1977 Deering, Jr. ..... 225/47
5,228,612 A * 7/1993 Kuo et al. ..... 225/47
5,456,421 A * 10/1995 Reed ..... 242/598.2
5,597,135 A * 1/1997 Vandersteene ..... 242/599.4
5,667,626 A * 9/1997 Cayford et al. ..... 156/577
6,371,403 B1 4/2002 Shen

* cited by examiner

*Primary Examiner*—Kathy Matecki
*Assistant Examiner*—Scott J. Haugland
(74) *Attorney, Agent, or Firm*—Birch, Stewart, Kolasch & Birch, LLP

(57) ABSTRACT

An adhesive tape reel loading structure includes a displacement plate with an axle mounted thereon and being housed in a housing compartment of a tape stand and a loading disk mounting on the axle. The loading disk has an inner ring for holding a small adhesive tape reel and an outer ring for holding a large adhesive tape reel. The outer ring has an opening to allow the small adhesive tape reel mounting on the inner ring to pass through. The loading disk may be separated from the restriction of the housing compartment by moving the displacement plate by force to allow adhesive tape reels of a small inner diameter and a large inner diameter be installed on or removed from the inner ring and the outer ring for use.

7 Claims, 7 Drawing Sheets

ADHESIVE TAPE REEL LOADING STRUCTURE

FIELD OF THE INVENTION

The present invention relates to an adhesive tape reel loading structure and particularly to an adhesive tape reel loading structure for use in a tape stand.

BACKGROUND OF THE INVENTION

The commonly used adhesive tape stands mainly include a pedestal with a tape reel housing compartment and a cutter located thereon. An axle is provided to hold a reel of adhesive tape, then the axle may be placed on the top section of the housing compartment with the tape reel held in the housing compartment for use. When in use, pull the tape from one end, and the axle will be turned to allow the tape to extend and release. When the tape is extended to a desired length, it may be cut off by means of the cutter. The tape may be replenished when used up.

The tape stand thus constructed has the axle separated. The axle and the tape reel are held on the tape stand without effective anchoring. When the pulling force is too strong or the stand is skew, the axle could be dropped out of the housing compartment and result in entangling of the adhesive tape. It could incur a lot of troubles to users. To resolve these problems, many improvements have been developed and proposed. Applicant also has proposed a solution disclosed in ROC Patent Application No. 089207945, entitled: "Improved axle structure for tape stand" (referring to FIG. 1). It includes a tape stand 30*a* which has a tape reel housing compartment 31*a*, a displacement plate 20*a* pivotally engaging with an inner wall of the housing compartment 31*a*, and an axle 21*a* mounting to the displacement plate 20*a* for holding a reel of adhesive tape. The displacement plate 20*a* may be turned and lifted away from the housing compartment 31*a* for replenishing the tape. After the tape reel is replaced and loaded, the displacement plate 20*a* may be returned into the housing compartment 31*a*. The displacement plate 20*a* can securely hold the axle 21*a* and prevent the tape reel from dropping off or entangling.

However the aforesaid tape loading structure of employing the lifting displacement plate or other improved tape loading structures still have disadvantages when put to practical use.

In general, there are a wide variety of adhesive tapes, such as double-side tapes, transparent tapes, insulation tapes, air permeable tapes, and special purpose tapes, and the likes. However standard inner diameter specifications of tape reels can be grouped in tape reels of small inner diameters (26, 31 or 36 mm) and large inner diameters (77 or 78 mm). The present techniques for tape stands generally cannot be simultaneously adopted for holding large and small tape reels. The small tape reel usually is directly mounted on the axle. To hold the large tape reel, an additional auxiliary ring is required to effectively anchor the tape reel. As a result, one tape stand cannot support two types of tape reels. When there is a need for alternate use, an additional feature has to be prepared. It creates a lot of inconveniences to users.

SUMMARY OF THE INVENTION

Therefore the primary object of the invention is to resolve aforesaid disadvantages. The invention provides an adhesive tape reel loading structure that may hold adhesive tape reels of different inner diameter specifications to enable users to use various adhesive tapes without adding extra features.

To achieve the foregoing objects, the adhesive tape reel loading structure of the invention includes a displacement plate with an axle mounted thereon and housed in a housing compartment of a tape stand and a loading disk coupling with the axle. The loading disk has an inner ring for holding a small tape reel and an outer ring for holding a large tape reel. The outer ring has an opening to allow the small tape reel mounting on the inner ring to pass through. The displacement plate may be pivotally turned and lifted to allow the loading disk to escape from the housing compartment. A small tape reel and a large tape reel may be respectively mounted or removed from the inner ring and the outer ring. Thus the invention is capable of supporting adhesive tapes of small and larger inner diameters.

The foregoing, as well as additional objects, features and advantages of the invention will be more readily apparent from the following detailed description, which proceeds with reference to the accompanying drawings.

DESCRIPTION OF THE PREFERRED EMBODIMENT

Figure 1:
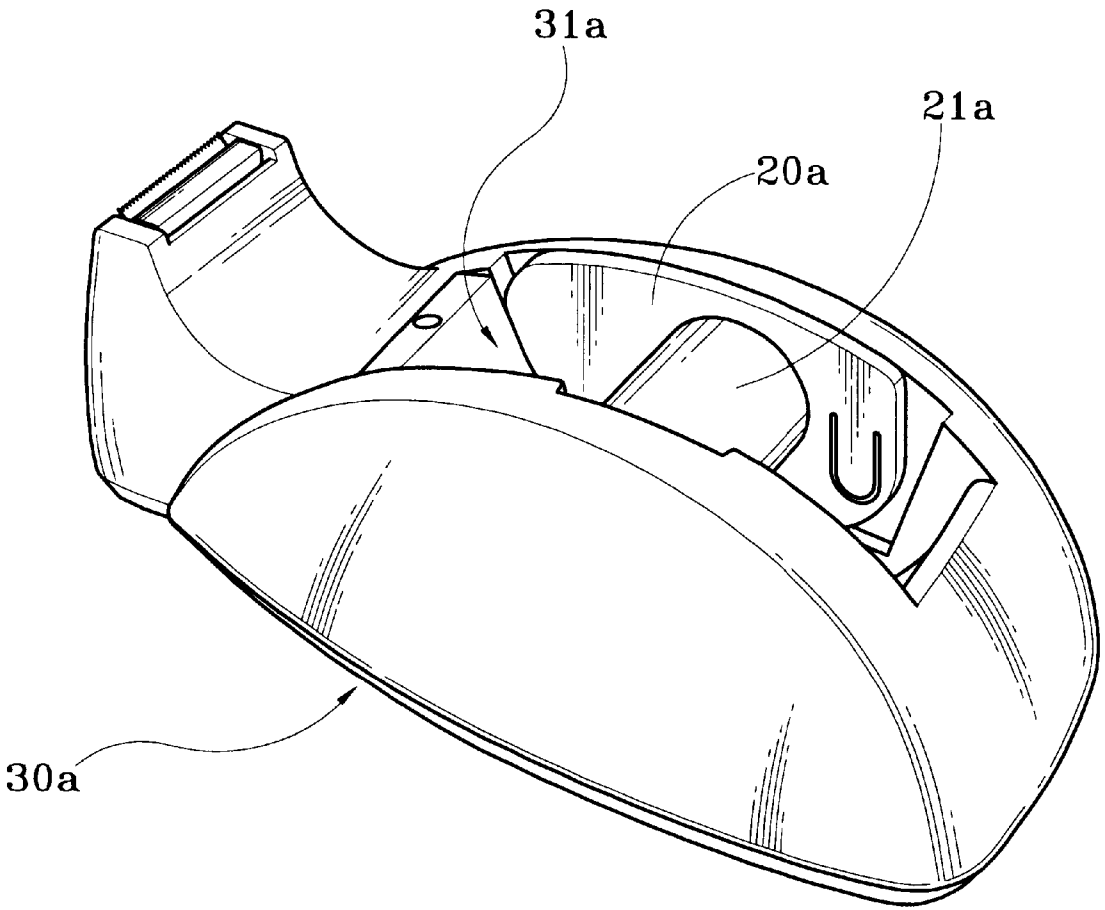
FIG. 1 is a perspective view of a conventional tape stand.
Figure 2:
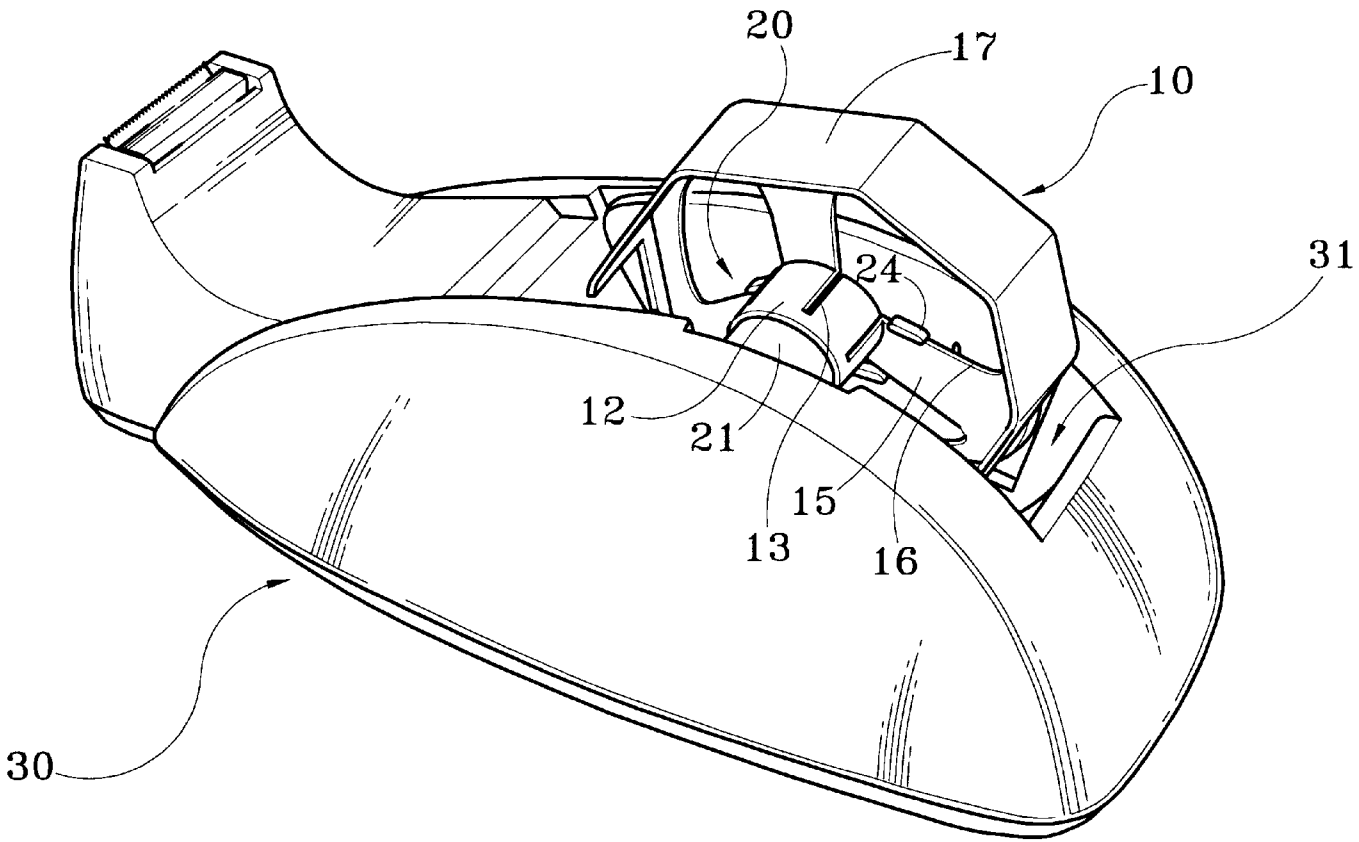
FIG. 2 is a perspective view of the invention.
Figure 3:
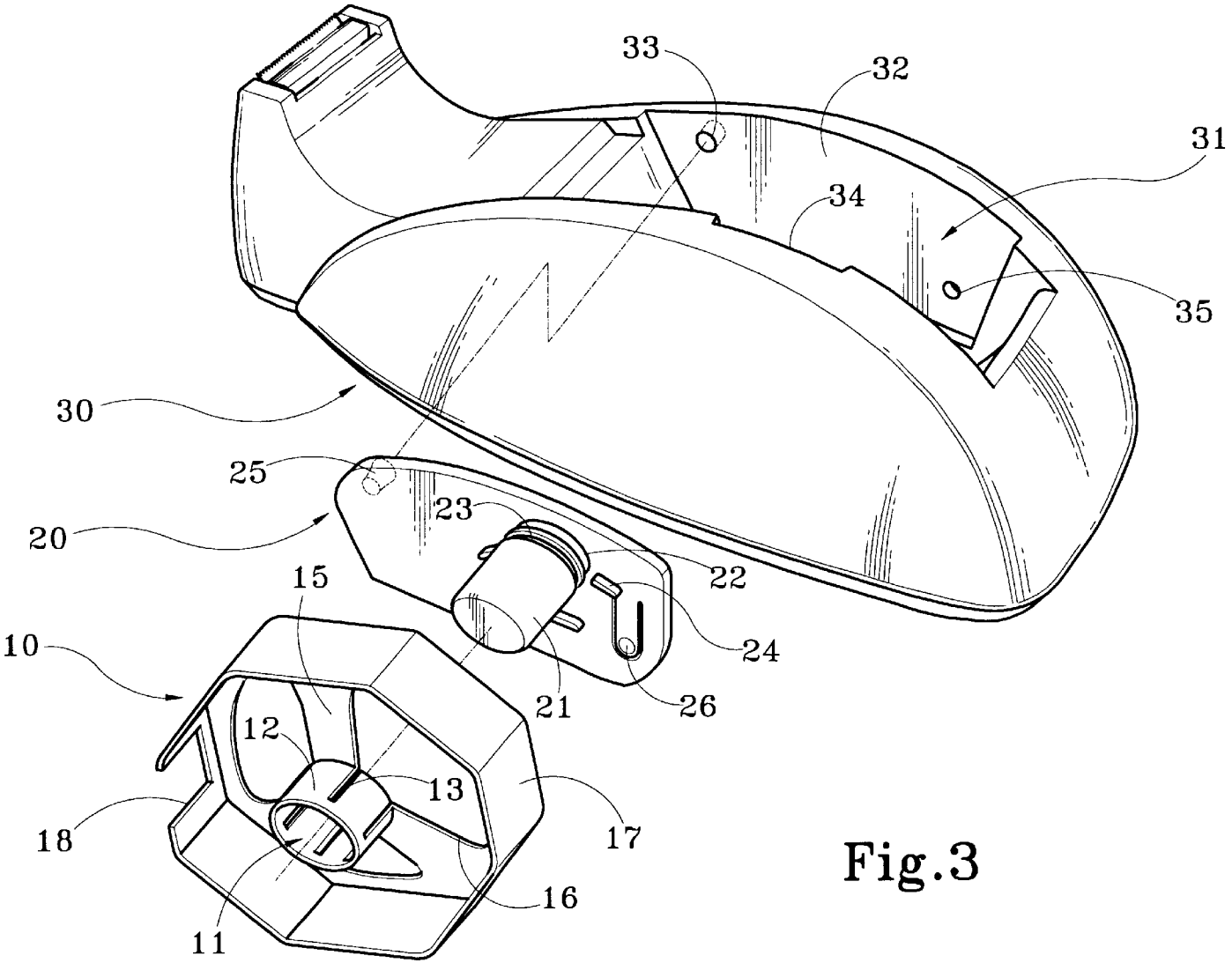
FIG. 3 is an exploded view of the invention.
Figure 4:
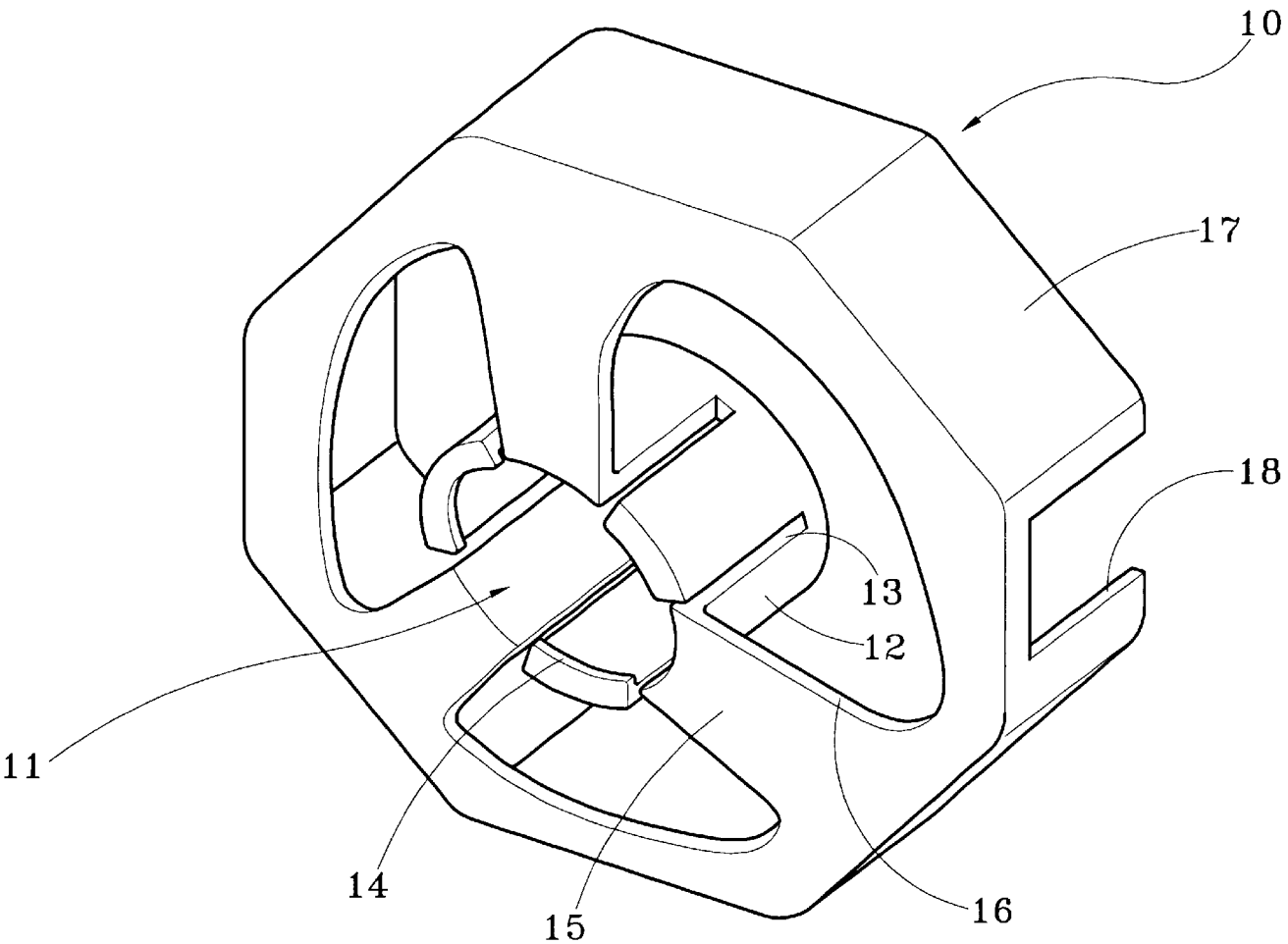
FIG. 4 is a schematic view of the loading disk of the invention.

Referring to FIGS. 2, 3 and 4, the adhesive tape reel loading structure of the invention is housed in a housing compartment 31 of a tape stand 30 for holding adhesive tape reels of small and large inner diameters (not shown in the drawings). The adhesive tape reel loading structure includes a displacement plate 20 with an axle 21 mounting thereon and pivotally housed in the housing compartment 31 of the tape stand 30, and a loading disk 10 coupling with the axle 21. The loading disk 10 has an inner ring 12 for holding a small tape reel and an outer ring 17 for holding a large tape reel. The outer ring 17 further has an opening 18 to allow the small tape reel held on the inner ring 12 to pass through. The displacement plate 20 may be pivotally turned and lifted upwards to allow the loading disk 10 to escape from the housing compartment 31 such that adhesive tape reels of a small inner diameter and a large inner diameter may be respectively mounted on or removed from the inner ring 12 and the outer ring 17.

The housing compartment 31 of the tape stand 30 has a recess 32 formed on an inner wall to allow the displacement plate 20 wedging therein to form a smooth surface on the inner wall. On another inner wall of the housing compartment 31 opposite to the recess there is a channel trough 34 to receive and confine the axle 21 mounted with the loading disk 10 so that it can be securely held in the housing compartment 31.

The displacement plate 20 and the housing compartment 31 have respectively one inner side facing each other. The facing inner sides have respectively a pivotal stub 25 and a matching pivotal aperture 33, and a retaining stub 26 and a matching anchoring cavity 35 formed thereon to pivotally engage with each other, thereby the displacement plate 20 may be pivotally turned and anchored in the housing compartment 31. The inner ring 12 of the loading disk 10 has a center hole 11 formed therein for coupling with the axle 21. The inner ring 12 and the outer ring 17 are bridged by a connecting plate 15. The inner ring 12 further has a latch section 14 which is alternately engageable with a first groove 22 and a second groove 23 formed on the periphery of the axle 21. The connecting plate 15 has an anchoring opening 16 which may be wedged and retained by anchoring stubs 24 located on the displacement plate 20 to harness the loading disk 10. Through the first groove 22 and the second groove 23, the interval between the loading disk 10 and the displacement plate 20 may be altered. And through the anchoring opening 16 and the anchoring stubs 24, the loading disk 10 may be closely contacted on the displacement plate 20 and latched without turning, such that the loading disk 10 may be either freely turned when holding a large adhesive tape reel, or may be harnessed stationary when holding a small tape reel to allow the tape to pass through the opening 18 without wobbling and free the tape from entangling, and to make pulling of the adhesive tape easier.

In addition, the inner ring 12 has a plurality of axial slots 13 to form crevices such that the latch section 14 is easier to switch between the first groove 22 and the second groove 23. The outer ring 17 may be formed in a polygon or a circle, but preferably a polygon so that the tangent angles of the polygon may wedge on the inner perimeter of the tape reel to facilitate tape reel installation or removing.

Figure 6:
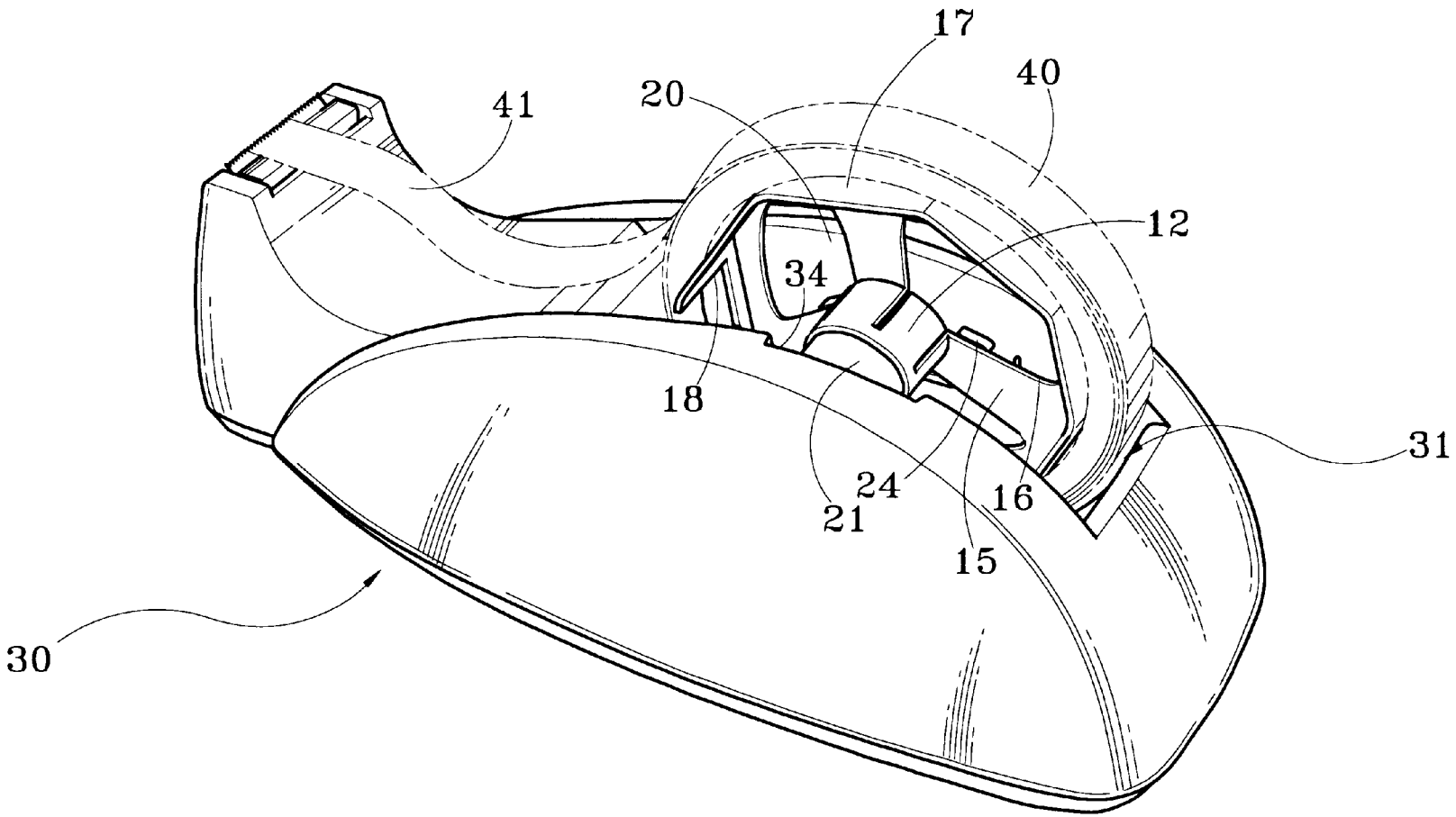
FIG. 6 is a schematic view of the invention in an use condition.
Figure 7:
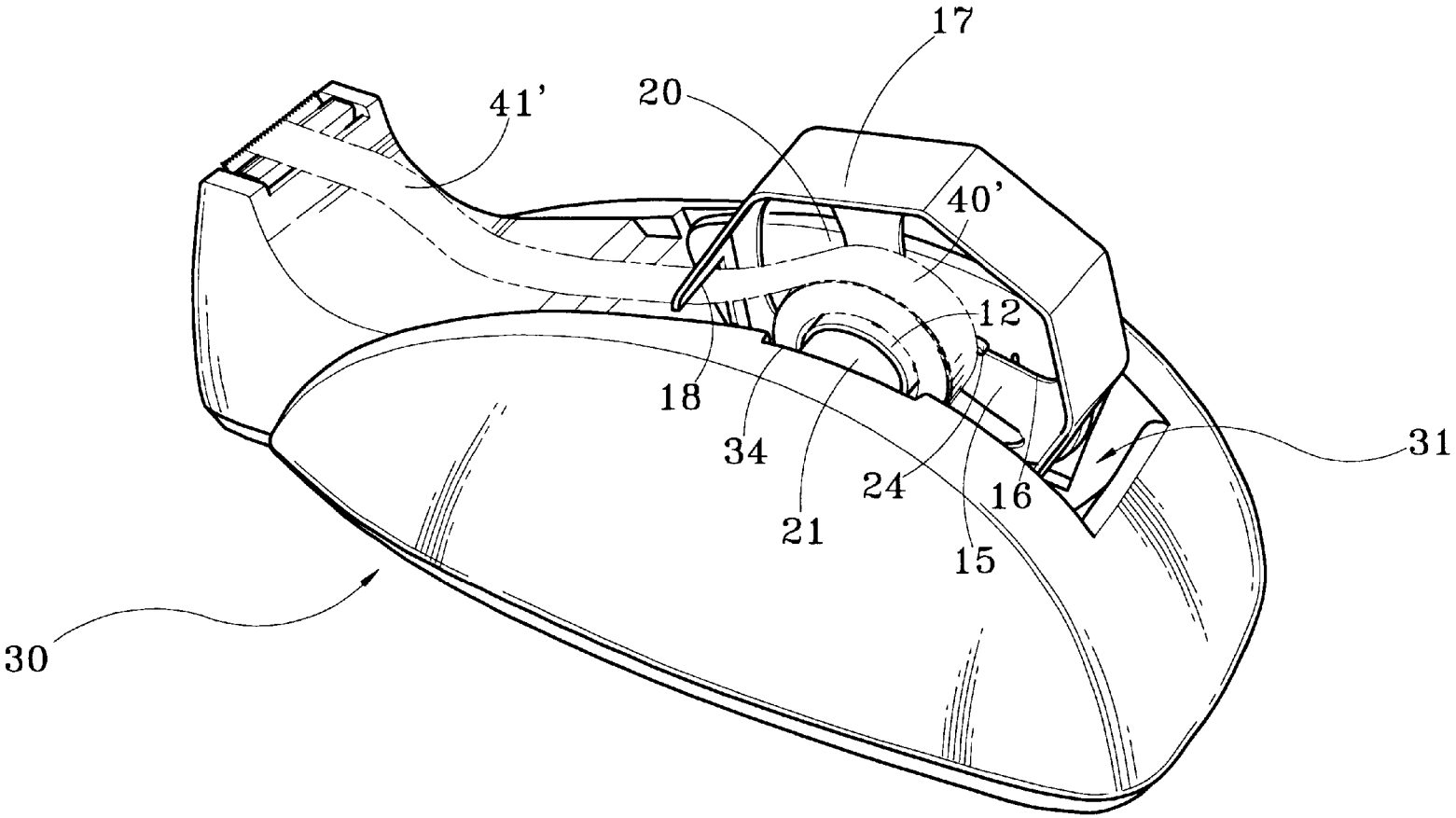
FIG. 7 is a schematic view of the invention in another use condition.

Referring to FIGS. 6 and 7, when in use, the latch section 14 of the loading disk 10 is latched on the first groove 22 or the second groove 23 to match a small tape reel 40' or a large tape reel 40. When to use the large tape reel 40 (shown in FIG. 6), move and lift the displacement plate 20 about the pivotal stub 25 which serves as the fulcrum, the axle 21 and the loading disk 10 may be moved outside the housing compartment 31, and engage the latch section 14 with the first groove 22, and hold the large tape reel 40 on the outer ring 17, then move the loading disk 10 in the housing compartment 31 again. As the loading disk 10 is freed from harness, it may be freely turned through the center hole 11 about the axle 21 to allow the adhesive tape 41 be pulled and used as a conventional tape stand does.

Figure 5B:
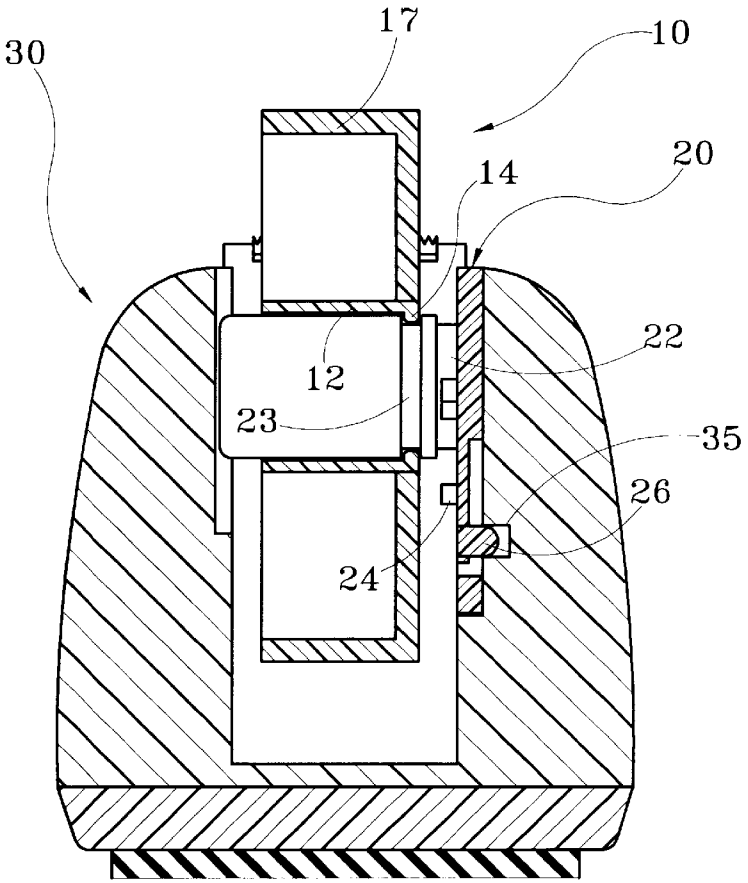
FIGS. 5A and 5B are schematic views of the loading disk of the invention in various operating conditions.
Figure 5A:
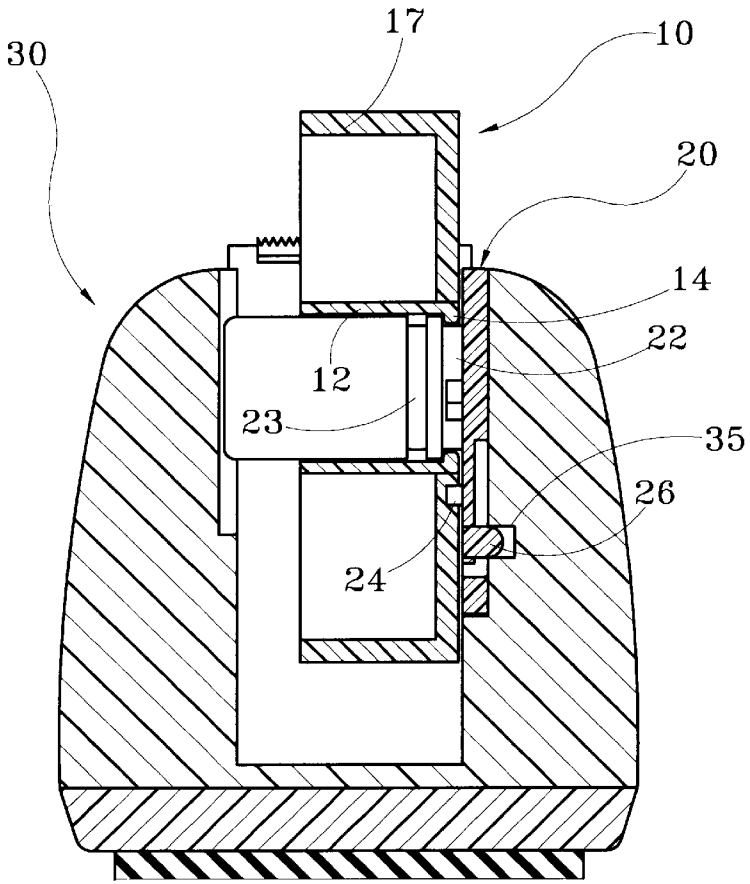

When to use the small tape reel 40' (shown in FIG. 7, also referring to FIGS. 5A and 5B), move and lift the displacement plate 20 outside the housing compartment 31, and engage the latch section 14 with the second groove 23, and hold the small tape reel 40' on the inner ring 12 of the loading disk 10, pull the adhesive tape 41' through the opening 18, then move the loading disk 10 in the housing compartment 31 again. As the anchoring opening 16 of the connecting plate 15 of the loading disk 10 is confined by the anchoring stubs 24 of the displacement plate 20, the loading disk 10 is harnessed and cannot be turned. And the position of the opening 18 of the outer ring 17 is maintained stationary. Therefore the adhesive tape 41' may be pulled out through the opening 18 without sticking to the loading disk 10 or incurring entangling. Thus the tape stand 30 of the invention may also be used for the small tape reel 40' as a conventional tape stand does.

What is claimed is:

1. An adhesive tape reel loading structure housed in a housing compartment of a tape stand for holding an adhesive tape reel of a small inner diameter and an adhesive tape reel of a large inner diameter, comprising:

a displacement plate engaging with the housing compartment and having an axle mounted to one side thereof; and a loading disk mounted on the axle and having an inner ring for holding a small adhesive tape reel and an outer ring for holding a large adhesive tape reel, the outer ring having an opening to allow the small adhesive tape reel held on the inner ring to pass through;

wherein the loading disk is movable to separate from restriction of the housing compartment when the displacement plate is driven by a force to allow the adhesive tape reels of the small inner diameter and the large inner diameter to be installed on or removed from the inner ring and the outer ring for use;

wherein the inner ring of the loading disk has a center hole formed therein to house the axle, the inner ring and the outer ring being bridged by a connecting plate;

wherein the inner ring has a latch section matching and alternately engaging with a first groove and a second groove formed on the axle, the connecting plate having an anchoring opening engageable with anchoring stubs formed on the displacement plate, the loading disk being spaced from the displacement plate for an interval which is changeable through the first groove and the second groove, the loading disk being allowed to be moved close to and engage with the displacement plate through the anchoring opening and the anchoring stubs to harness the loading disk from turning such that the loading disk is allowed to turn freely when installing the large adhesive tape reel, and the loading disk is stationary when installing the small adhesive tape reel and the opening is prevented from moving to allow the adhesive tape to pass through.

2. The adhesive tape reel loading structure of claim 1, wherein the housing compartment has a recess formed on an inner wall thereof for movement of the displacement plate therein.

3. The adhesive tape reel loading structure of claim 2, wherein the displacement plate and the recess have respectively an inner side facing each other, the inner sides having respectively a retaining stub and an anchoring cavity formed thereon to match and engage with each other for anchoring the displacement plate.

4. The adhesive tape reel loading structure of claim 1, wherein the displacement plate and the housing compartment have respectively an inner side facing each other, the inner sides having respectively a pivotal stub and a pivotal aperture located thereon to match and pivotally engage with each other.

5. The adhesive tape reel loading structure of claim 1, wherein the inner ring has a plurality of slots to facilitate switching of engagement between the latch section and the first groove and the second groove.

6. The adhesive tape reel loading structure of claim 1, wherein the housing compartment has an inner wall corresponding to the axle with a channel trough formed thereon to provide a displacement for the axle.

7. The adhesive tape reel loading structure of claim 1, wherein the outer ring is a polygon, which has tangent angles to wedge the adhesive tape reel.

* * * * *